US007108099B2

(12) United States Patent
Ador

(10) Patent No.: US 7,108,099 B2
(45) Date of Patent: Sep. 19, 2006

(54) PERSONAL SAFETY METHODS AND APPARATUS

(75) Inventor: Bernard R. Ador, Mandelieu (FR)

(73) Assignee: Capital Safety Group EMEA, Carros Cedex (FR)

( * ) Notice: Subject to any disclaimer, the term of this patent is extended or adjusted under 35 U.S.C. 154(b) by 702 days.

(21) Appl. No.: 10/013,319

(22) Filed: Oct. 30, 2001

(65) Prior Publication Data

US 2002/0112916 A1 Aug. 22, 2002

(30) Foreign Application Priority Data

Nov. 2, 2000 (FR) ..... 00 14074

(51) Int. Cl.
*A62B 29/00* (2006.01)

(52) U.S. Cl. ..... 182/5; 182/192; 188/65.5

(58) Field of Classification Search ..... 182/5, 182/191–193; 188/65.1, 65.4, 65.5
See application file for complete search history.

(56) References Cited

U.S. PATENT DOCUMENTS 320,664 A * 6/1885 Lee ..... 188/65.3
376,622 A * 1/1888 Abbott ..... 182/192
383,211 A * 5/1888 Calkins ..... 188/65.3
387,436 A * 8/1888 O'Neil ..... 182/100
1,033,311 A * 7/1912 Huber ..... 182/240
3,142,263 A * 7/1964 Craft ..... 104/202
3,437,178 A * 4/1969 Postlethwait ..... 188/65.2
4,846,075 A * 7/1989 Tupper ..... 104/209
5,316,103 A 5/1994 Bell et al. ..... 182/18
5,860,493 A 1/1999 Cherpitel ..... 188/65.2
5,934,408 A 8/1999 Flux ..... 182/5
6,059,072 A * 5/2000 Cho ..... 182/193
6,155,384 A * 12/2000 Paglioli ..... 188/65.2

FOREIGN PATENT DOCUMENTS

DE 3510602 A1 9/1986
FR 2626184 A1 * 7/1989

* cited by examiner

*Primary Examiner*—Alvin Chin-Shue
(74) *Attorney, Agent, or Firm*—IPLM Group, P.A.

(57) ABSTRACT

A safety anchor (20) for securing a user to a substantially vertical safety structure, e.g., elevator cable (21). Safety anchor (20) includes a back plate (26) to which are pivotally mounted a roller (28), inner cam assembly (30) and outer cam assembly (32). Each cam assembly (30,32) includes a lever arm (50,36) to which is mounted a cam (52,42). A user (25) is secured by means of carabiners and a short tether cable, for example, to the free ends of lever arms (50,36). Cable (21) threads between cams (52,42) which are pivoted to compress the cable in response to downward force exerted against the lever arms (50, 36).

13 Claims, 4 Drawing Sheets

PERSONAL SAFETY METHODS AND APPARATUS

FIELD OF THE INVENTION

The present invention relates generally to safety anchors that support a user relative to a vertical cable or other similar support structure.

BACKGROUND OF THE INVENTION

Various methods and apparatus have been provided for purposes of protecting persons who work, or otherwise find themselves, at dangerous heights. In some situations, including elevator shafts, for example, a vertical cable is available as a suitable structure for anchoring a safety device. Generally speaking, it is desirable to secure a safety device to such a cable in a manner which allows a person to move along the cable or lock onto the cable at his discretion, and which automatically locks onto the cable and/or remains locked onto the cable in the event of a fall or an excessively rapid descent. It is also desirable for such a safety device to engage cables of various diameters and/or in a manner which does not damage the cables.

SUMMARY OF THE INVENTION

Generally speaking, the present invention includes a safety device suitable for interconnection in series between a person and an elongated support structure, and specifically designed for use in connection with elevator cables and other vertically extending supports. The device includes a base; first and second lever arms pivotally connected the base; first and second cams or eccentric hubs on the respective lever arms; and a fastener interconnected between the distal ends of the respective lever arms. The fastener connects the user to the device, via a harness and a lanyard, for example, and the weight of the user acts upon the distal ends of the lever arms in a manner which causes the cams to engage the safety structure with progressively increasing force.

The device preferably includes a roller rotatably connected to the base and arranged to engage the cable in a manner which enhances the force imparted by the cams against the safety structure. Also, the cams are preferably configured and arranged to contact the cable at discrete longitudinal locations. Furthermore, one of the lever arms is preferably pivotal between an open position, allowing access to a gap defined between the cams, and a closed position, disposed across the gap with its distal end aligned with the distal end of the other lever arms to receive a fastener. On the preferred embodiment, the frame, lever arms and cams are constructed of plates that are arranged in substantially parallel planes or "sandwiched" fashion.

The present invention may also be described in terms of a safety anchor system for securing a user to an elevator cable or other elongated support structure. The system includes a cable; the device described above mounted on the cable; a harness; and a fastener interconnected between the harness and the distal ends of the lever arms. Additional features and/or advantages of the present invention may become apparent from the more detail description that follows.

BRIEF DESCRIPTION OF THE DRAWINGS

FIG. 3 is a partially exploded, perspective view of the safety anchor of FIG. 2;

DETAILED DESCRIPTION OF THE PREFERRED EMBODIMENT

Figure 1:
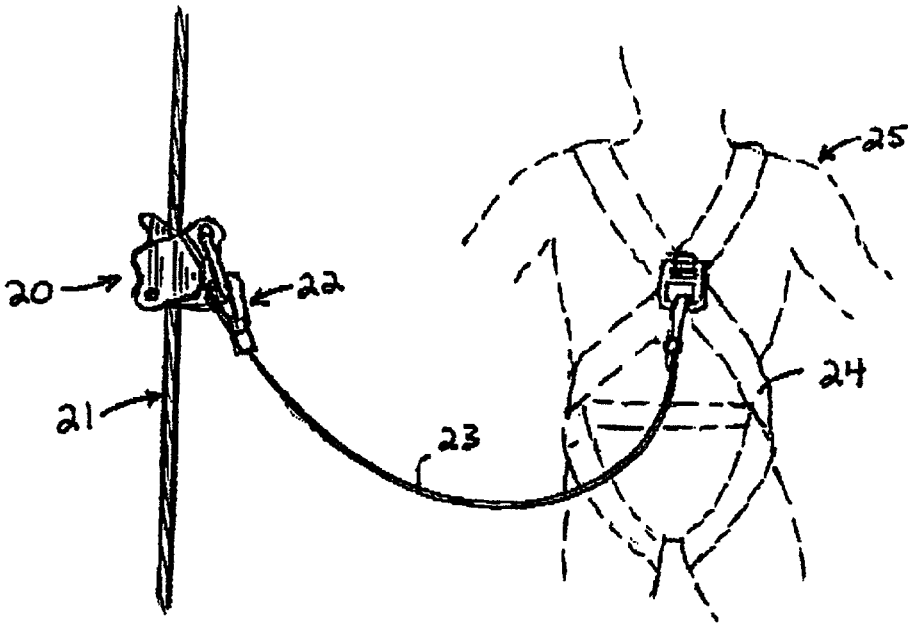
FIG. 1 is a front view of a preferred safety anchor system constructed according to the principles of the present invention.
Figure 2:
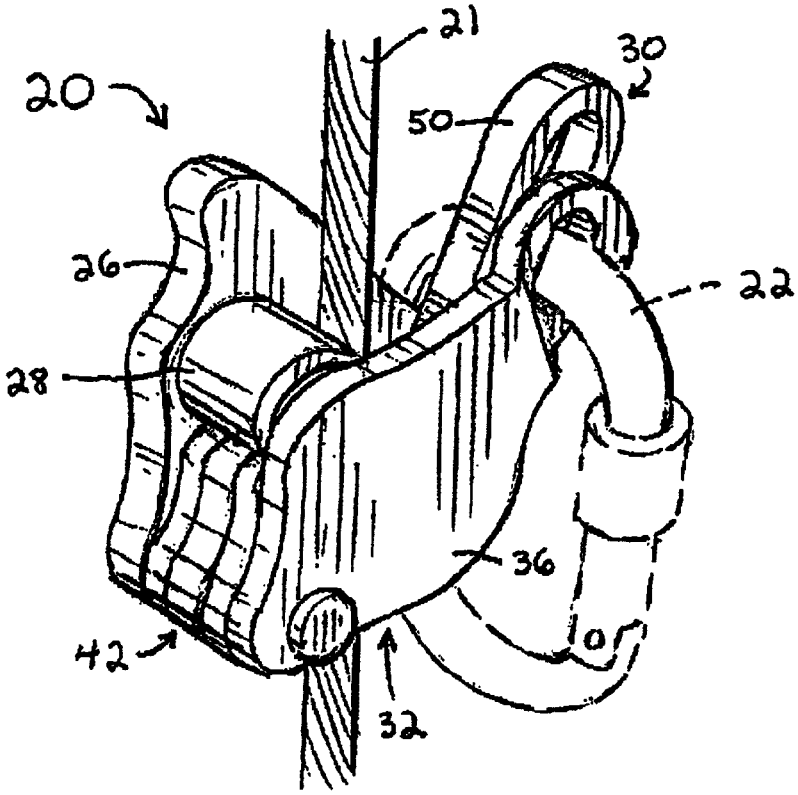
FIG. 2 is an enlarged perspective view of a safety anchor portion of the system of FIG. 1.

With reference to the Drawings, wherein like reference numerals designate like parts and assemblies throughout the several views, FIG. 1 shows a preferred embodiment safety system constructed according to the principles of the present invention. The system includes a preferred embodiment safety anchor which is designated as 20 in FIG. 1–9. Safety anchor 20 is releasably coupled to a vertical safety structure, such as elevator cable 21. Safety anchor 20 is also connected to a carabiner 22, and a short lanyard or tether 23 is interconnected in series between the carabiner 22 and a belt or harness 24 worn by a person 25. Persons skilled in the art will recognize that the preferred embodiment anchor 20 is designed for use on elevator cable 21, although depicted herein as an elevator cable, but the principles of the present invention may be implemented relative to other elongate structures, as well. Also, there are various known ways for coupling the anchor 20 to the user 25, and the carabiner 22, tether 23, and safety harness 24 constitute just one example.

Anchor 20 preferably includes a base or frame which can be in the form of back plate 26, in this case fabricated from 6 mm thick steel plate. As shown in FIG. 3, back plate 26 is preferably substantially triangular in shape, having an upper lobe 27*a* and lower left and right lobes 27*b* and 27*c*, respectively. Rotatably secured to back plate 26, roughly midway between left lobe 27*b* and upper lobe 27*a*, is a neoprene coated roller 28. Pivotally secured to lower right lobe 27*c* is an inner cam assembly 30; and pivotally secured to lower left lobe 27*b* is an outer cam assembly 32. Back plate 26, roller 28, and cam assemblies 30 and 32 all work in conjunction to engage cable 21 in an advantageous manner, as described more fully below. Back plate 26 is substantially planar, as are most of the other components of anchor 20, and the components are configured and arranged to be substantially parallel to one another, in a "sandwiched" style of construction.

Roller 28 is preferably constructed of steel and coated in conventional fashion with a plastic material such as neoprene. A low friction coating material is used since the function of roller 28, as described below, is not to grip cable 21 but rather to bear against the cable to prevent bending or curving of the cable and to facilitate gripping of the cable by cam assemblies 30 and 32. A conventional fastener 33 (see FIG. 6) secures the neoprene coated roller 28 to back plate 26 in such a way that roller 28 can freely spin as it bears against cable 21.

As shown in FIG. 3, outer cam assembly 32 includes a substantially planar cam lever arm 36 which has four lobes 39*a*–39*d*. Lever arm 36 is pivotally connected to back plate 26 by means of a conventional metal pin or rivet 38 extending through lever arm lobe 39*d* and back plate lobe 27*b*. Lever arm 36 is preferably fabricated from 4 mm thick plate steel and is generally planar, with the exception of lobe 39*a*, which is displaced toward back plate 26. Lobe 39*a* forms a short slot 46 for receiving carabiner 22.

Figure 6:
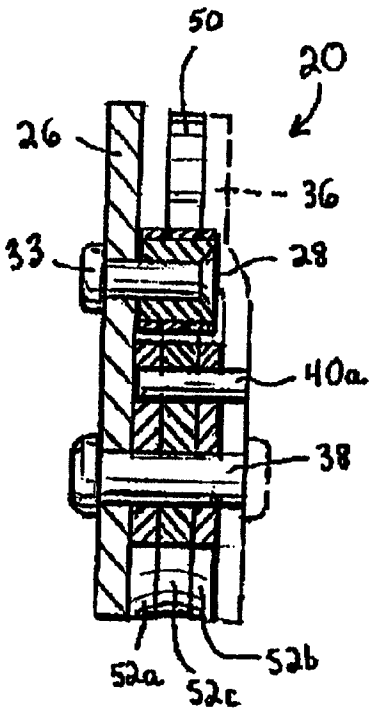
FIG. 6 is a side sectional view of the safety anchor of FIG. 2, taken generally along line 6—6 of FIG. 4.

Secured to outer lever arm 36 by means of pins or rivets 40*a* and 40*b* is an outer cam 42. As shown in FIG. 3 and 6, cam 42 includes layered plates 42*a*, 42*b* and 42*c*. Cam 42 is so constructed to permit it to be fabricated from plate steel which, in this preferred embodiment, is either 4 or 6 mm thick. In particular, cam plate 42*a* is 4 mm; cam plate 42*b* is 6 mm; and cam plate 42*c* is 4 mm thick. The three cam plates 42 have the same platform or perimeter, and are fixed together by means of pins or rivets 40*a* and 40*b*, as shown in FIG. 6.

Inner cam assembly 30 is similar in many respects to outer cam assembly 32. Assembly 30 includes an elongated lever arm 50 having a lower end sandwiched between a pair of inner cam plates 52*a* and 52*b*. Pins or rivets 54*a* and 54*b* secure cam plates 52*a* and 52*b* to lever arm 50. The lower periphery of lever arm 50 is shaped like cam plates 52*a* and 52*b* and thus, is designated as 52*c*, and the three layered "sandwich" constitutes the inner cam 52. FIG. 6 shows a side elevational view of a portion of inner cam 52. Cam plate 52*a* is preferably 4 mm thick plate steel; plate 52*c* (and the entire inner lever arm 50) is 6 mm thick plate steel; and plate 52*b* is 4 mm thick plate steel.

The entire cam assembly 30 is pivotally connected to the lower right lobe 27*c* of back plate 26 by fastener 56. Lever arm 50 forms a relatively long closed slot 58 running from cam 52 to the far end of lever arm 50. Slot 58 may be aligned with slot 46 in the outer lever arm 36.

Figure 5:
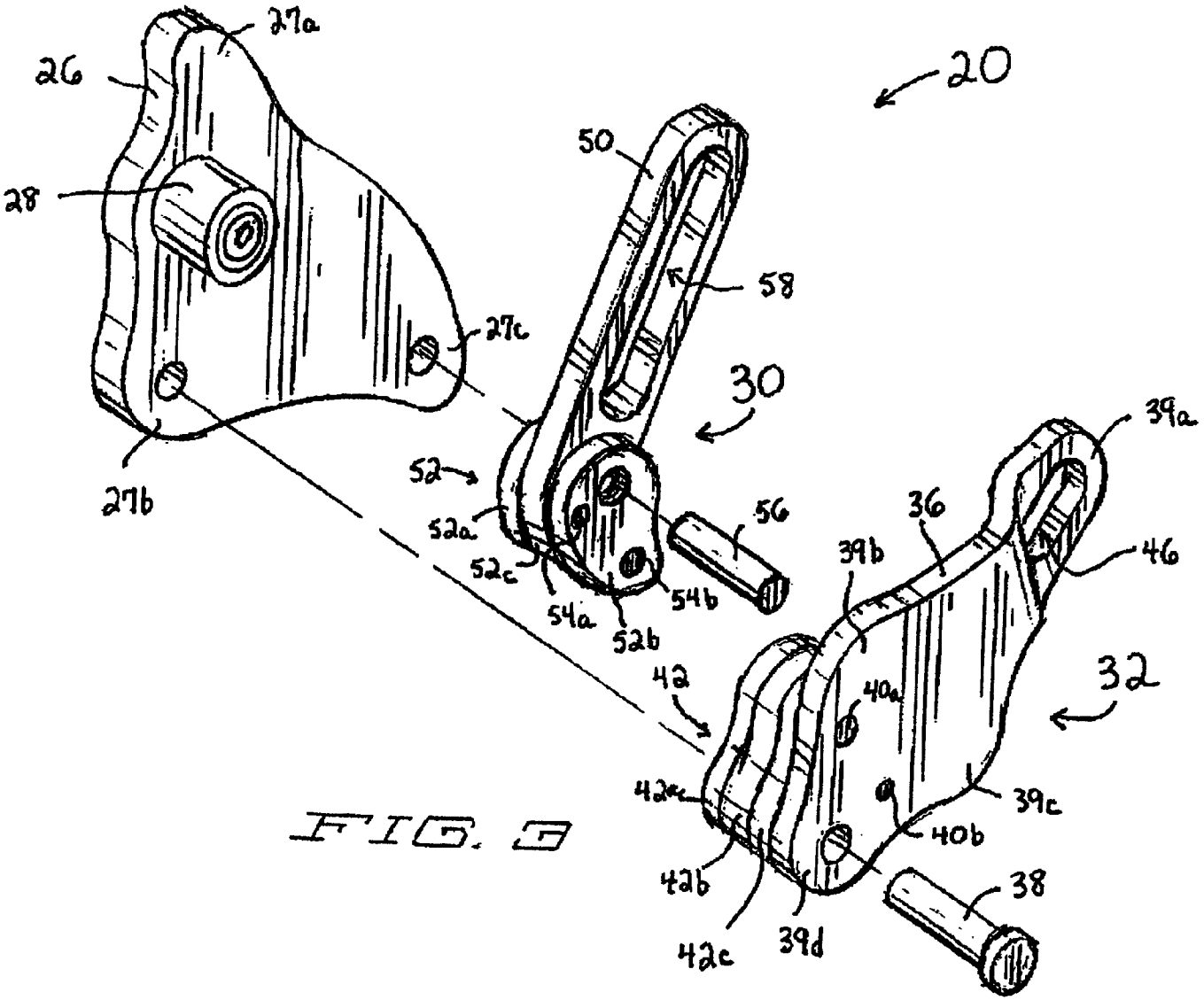
FIG. 5 is a front elevational view of the safety anchor of FIG. 2, with the outer lever arm shown in phantom to reveal the inner structure, and with the cam assemblies in their respective engaged positions.
Figure 5:
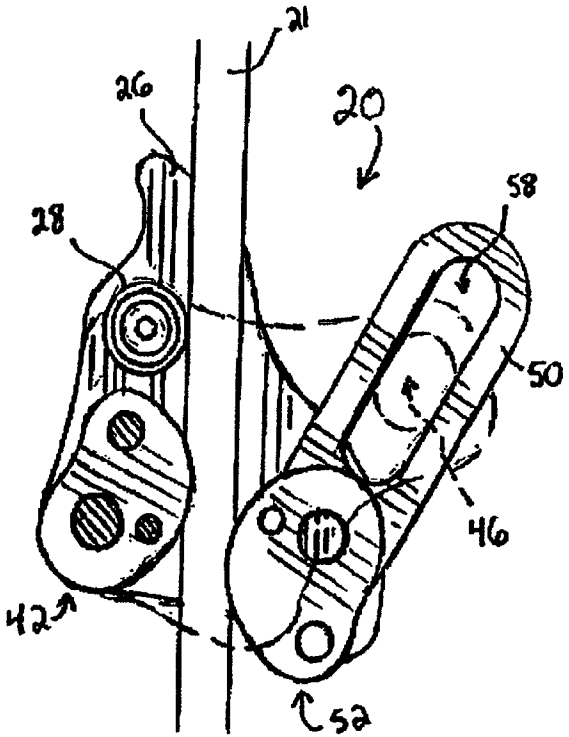
Figure 4:
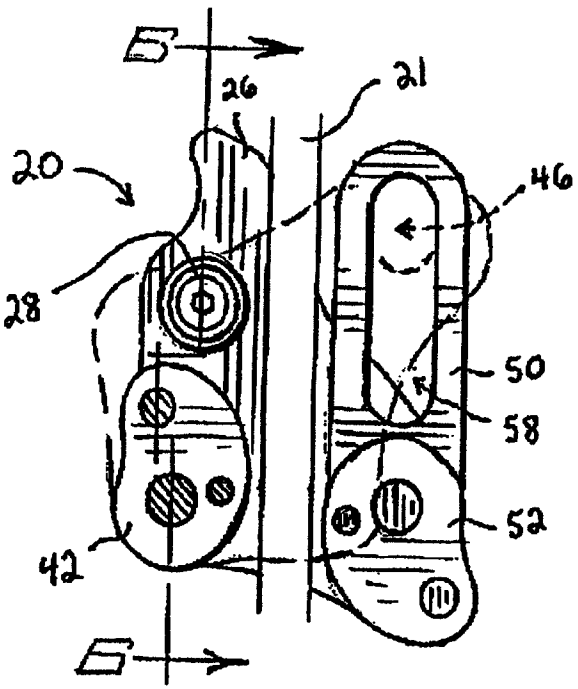
FIG. 4 is a front elevational view of the safety anchor of FIG. 2, with the outer lever arm shown in phantom to reveal the inner structure, and with the cam assemblies in their respective disengaged positions.

FIG. 4–6 illustrate how the various parts of safety anchor 20 align and fit together. Among other things, inner and outer cams 52 and 42, respectively, are radially aligned with the roller 28. FIG. 6 illustrates, at the bottom thereof, how the inner cam 52 is "sheaved" to keep cable 21 centered within anchor 20 and prevent binding and/or damage to cable 21. Outer cam 42 is preferably "sheaved" in similar fashion. The cams 42 and 52 are configured to accommodate cable diameters ranging from 8 to 13 mm. Of course, anchor 20 could be modified to accommodate smaller or larger cables, if so desired.

FIG. 6 also shows how the upper end of outer lever arm 36, i.e., lobe 39*a*, is bent inwardly to interface with the free end of inner lever arm 50. The slotted portions of the lever arms are brought into close proximity to prevent binding of carabiner 22 within slots 46 and 58 and/or twisting of the components as anchor 20 is operated.

Figure 8:
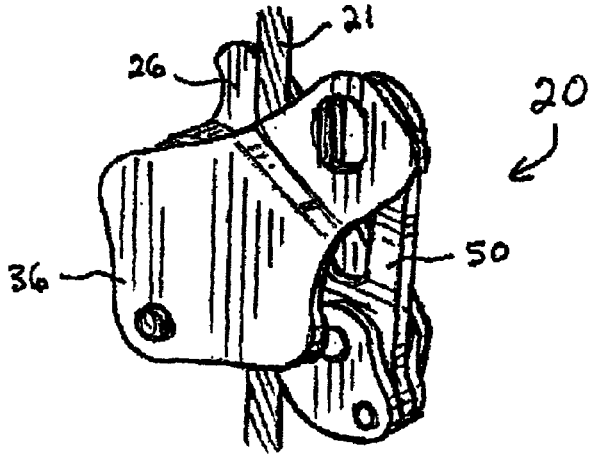
FIG. 8 is a perspective view of the safety anchor of FIG. 2, with the cam assemblies in their respective disengaged positions.
Figure 9:
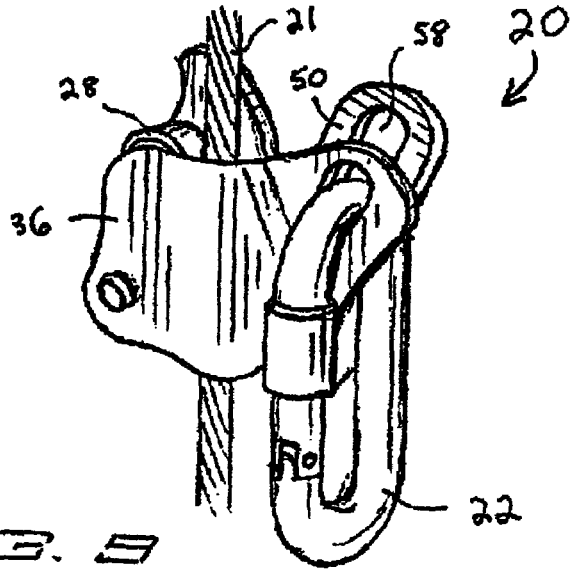
FIG. 9 is a perspective view of the safety anchor of FIG. 2, with the carabiner in place and the cam assemblies in their engaged positions.

Outer cam assembly 32 is movable between an open position (see FIG. 7), a closed but disengaged position (see FIGS. 4 and 8) and a closed and engaged position (see FIGS. 5 and 9). Similarly, inner cam assembly 30 is movable between a disengaged position (see FIGS. 4 and 8) and an engaged position (see FIGS. 5 and 9). When cam assemblies 30 and 32 are in their closed but disengaged positions (as they would be when the user is either holding up the lever arms or the user ascending the cable), cams 42 and 52 engage cable 21 with surfaces which have a relatively small radius (in plan view), measured from the centerlines of their respective pivot pins 38 and 56. As shown in FIG. 4, this arrangement permits cable 21 to freely slide between cams 42 and 52.

As shown in FIG. 5, when cam assemblies 30 and 32 are in their closed and engaged positions (as they would be to provide an anchor point on the cable), cams 42 and 52 engage cable 21 with surfaces having a relatively larger radius, as compared to when cam assemblies 30 and 32 are in the positions shown in FIG. 4. Cable 21 is thus compressed or pinched between cams 42 and 52. In the absence of roller 28, the result would urge deflection of the cable 21 toward an "S" configuration, because cams 42 and 52 do not engage cable 21 at the same point. However, the additional contact point provided by the roller 28 distributes moment forces more evenly along the cable.

FIGS. 4 and 5 illustrate how the long slot 58 in the inner lever arm 50 remains aligned with the shorter slot 46 in the outer lever arm 36 as the cam assemblies move between their respective closed positions. The long slot 58 is needed because the lever arms 50 and 36 pivot about discrete pivot axes. Thus, when cam assemblies 30 and 32 move from their disengaged positions to their engaged positions (i.e., FIG. 4 to FIG. 5), carabiner 22 moves down along slot 58 and toward pivot pin 56. FIGS. 4 and 5 also show that both lever arms 36 and 50 move clockwise from their respective disengaged positions to their respective engaged positions, though not necessarily through the same range of rotation.

Figure 7:
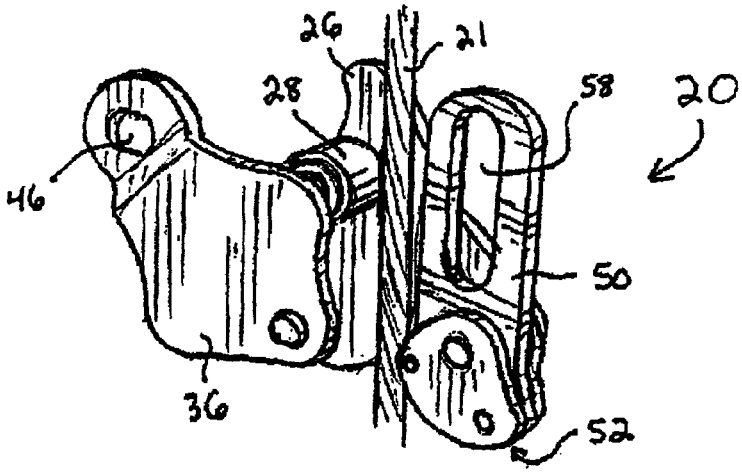
FIG. 7 is a perspective view of the safety anchor of FIG. 2, with the outer cam assembly in its open position to accept the cable.

FIG. 7–9 illustrate anchor 20 in use. FIG. 7 shows the device 20 in its open configuration, exposing a channel to accept cable 21 between cams 42 and 52 and to the right of roller 28. FIG. 8 shows the device 20 in its closed but disengaged configuration, with outer cam assembly 32 moved from its open position to its closed but disengaged position and slots 46 and 58 brought into alignment. FIG. 9 shows the device in its closed and engaged configuration, with carabiner 22 inserted through slots 46 and 58 and pulled downward to rotate lever arms 36 and 50 clockwise, causing cams 42 and 52 to engage and progressively "grab" cable 21. In this closed and engaged configuration, the device 20 provides an anchor point on cable 21, capable of holding a person in suspending fashion.

In one respect, the present invention may be described in terms of a safety device 20, comprising a base 26; a first lever arm 50 having an eccentric hub 52 pivotally connected to the base 26, and a distal end which defines a slot 58; a second lever arm 32 having an eccentric hub 42 pivotally connected to the base 26, and a distal end which defines an opening 46, wherein a variable width gap is defined between the hub 42 on the second lever arm 32 and the hub 52 on the first lever arm 50; and a fastener 22 interconnected between the slot and the opening. The safety device may be further described in terms of a first pivot axis defined between the first lever arm 50 and the base 26, and a discrete, pivot axis defined between the second lever arm 32 and the base 26; the opening 46 and the second axis being disposed on opposite sides of the gap; a roller 28 rotatably mounted on the base 26 on a side of the gap opposite the slot 58 and the opening 46; the second lever arm 32 being pivotal between an open position, wherein the gap is accessible, and a closed position, wherein the gap is covered; the first lever arm 50 being sandwiched between the base 26 and the second lever arm 32; and/or the fastener being a carabiner.

In another respect, the present invention may be described in terms of a safety device, comprising a base; a first lever arm having an eccentric hub pivotally connected to the base, and a distal end which defines a slot; and a second lever arm having an eccentric hub pivotally connected to the base, and a distal end which defines an opening, wherein a variable width gap is defined between the hub on the second lever arm and the hub on the first lever arm, and the second lever arm is movable between a first position, wherein the gap is accessible, and a second position, wherein the gap is inaccessible and the opening aligns with the slot. The safety device may be further described along the lines of the device described in the previous paragraph.

In yet another respect, the present invention may be described in terms of a safety system, comprising: a vertical cable; a safety garment designed to support a person in the event of a fall; and a safety device interconnected in series between the safety garment and the cable, the safety device being similar to those described above.

In still another respect, the present invention may be described in terms of a method of anchoring a person relative to a vertical cable, comprising the steps of: providing a vertical cable; providing a safety device with a base; a first lever arm having an eccentric hub pivotally connected to the base, and a distal end which defines a slot; a second lever arm having an eccentric hub pivotally connected to the base, and a distal end which defines an opening; positioning the safety device on the cable in such a manner that the cable is disposed within a variable width gap defined between the hub on the second lever arm and the hub on the first lever arm; securing a fastener relative to both the slot and the opening; and imparting a downwardly directed force on the fastener to rotate each hub in a manner that narrows the gap. The method may be further described in terms of the cams being configured and arranged to engage the cable at longitudinally distinct locations; the safety device including a roller rotatably mounted on the base and disposed on a side of the cable opposite the fastener; and/or the positioning of the safety device involving pivoting of the second lever arm relative to the base to expose the gap, positioning of the cable in the gap, and pivoting of the second lever arm relative to the base to cover the gap.

The present invention has been described with reference to a preferred embodiment and a specific application. Recognizing that additional embodiments, variations, and/or applications are possible, the scope of the present invention is to limited only to the extent of the claims that follow.

What is claimed is:

1. A safety device, comprising:

a base;

a first lever arm having an eccentric hub pivotally connected to the base, and a distal end which defines a slot;

a second lever arm having an eccentric hub pivotally connected to the base, and a distal end which defines an opening, wherein a variable width gap is defined between the hub on the second lever arm and the hub on the first lever arm; and a rigid fastener interconnected between overlapping portions of the slot and the opening in such a manner that each said lever arm is constrained to pivot clockwise in response to movement of the fastener in a first direction along the slot, and each said lever arm is constrained to pivot counter-clockwise in response to movement of the fastener in an opposite, second direction along the slot.

2. The safety device of claim 1, wherein the first lever arm pivots about a first axis relative to the base, and the second lever arm pivots about a discrete, second axis relative to the base.

3. The safety device of claim 2, wherein the opening and the second axis are disposed on opposite sides of the gap.

4. The safety device of claim 1, further comprising a roller rotatably mounted on the base, wherein the roller is disposed on one side of the gap, and the opening and the slot are disposed on an opposite side of the gap.

5. The safety device of claim 1, wherein the second lever arm is pivotal between an open position, wherein the distal end of the second lever arm is disposed to one side of the gap, and a closed position, wherein the distal end of the second lever arm covers the gap.

6. The safety device of claim 1, wherein the first lever arm is sandwiched between the base and the second lever arm.

7. The safety device of claim 1, wherein the fastener is a carabiner.

8. The safety device of claim 1, wherein the hub on each said lever arm moves in a manner that narrows the variable width gap in response to movement of the fastener in the first direction along the slot, and the hub on each said lever arm moves in a manner that widens the variable width gap in response to movement of the fastener in the second direction along the slot.

9. A safety device, comprising:

a base;

a first lever arm pivotally connected to the base at a first pivot axis, wherein the first lever arm has an eccentric hub, and a distal end which defines a slot;

a second lever arm pivotally connected to the base at a discrete, second pivot axis, wherein the second lever arm has an eccentric hub, and a distal end which defines an opening, and a variable width cable clamp is defined between the hub on the second lever arm and the hub on the first lever arm, and the second lever arm is movable between a first position, wherein the distal end of the second lever arm is disposed to a side of the cable clamp opposite the first lever arm, and a second position, wherein the distal end of the second lever arm spans the cable clamp, and the opening aligns with the slot; and a rigid fastener inserted through aligned portions of the opening and the slot.

10. The safety device of claim 9, wherein the hub on the second lever arm and the opening are disposed on opposite sides of the cable clamp.

11. The safety device of claim 9, further comprising a roller rotatably mounted on the base, wherein the roller is disposed on one side of the cable clamp, and the opening and the slot are disposed on an opposite side of the cable clamp.

12. A safety system, comprising:

a vertical cable;

a safety garment designed to support a person in the event of a fall; and a safety device interconnected in series between the safety garment and the cable, the safety device comprising:

a base;

a first lever arm pivotally connected to the base at a first pivot axis, wherein the first lever arm has an eccentric hub, and a distal end which defines a slot;

a second lever arm pivotally connected to the base at a discrete, second pivot axis, wherein the second lever arm has an eccentric hub, and a distal end which defines an opening, and the cable extends between the first pivot axis and the second pivot axis through a variable width cable clamp defined between the hub on the second lever arm and the hub on the first lever arm; and a rigid fastener extending through overlapping portions of the slot and the opening.

13. The safety device of claim 9, wherein each said lever arm is constrained to pivot clockwise in response to movement of the fastener in a first direction along the slot, and each said lever arm is constrained to pivot counter-clockwise in response to movement of the fastener in an opposite, second direction along the slot.

* * * * *